US006379181B1

(12) United States Patent
Chang et al.

(10) Patent No.: US 6,379,181 B1
(45) Date of Patent: Apr. 30, 2002

(54) ELECTRICAL CONNECTOR HAVING LOCKING DEVICE

(75) Inventors: Guo Hua Chang; Zi Qiang Zhu; Jin Qui Hu, all of Kun-Shan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/797,646

(22) Filed: Mar. 1, 2001

(30) Foreign Application Priority Data

Dec. 7, 2000 (TW) ..... 89221274 U

(51) Int. Cl.[7] ..... H01R 13/73
(52) U.S. Cl. ..... 439/567; 439/607
(58) Field of Search ..... 439/567, 571, 439/572, 607–610, 357, 358

(56) References Cited

U.S. PATENT DOCUMENTS 4,874,336 A * 10/1989 Marsh ..... 439/607
5,356,313 A * 10/1994 Niwa et al. ..... 439/607
5,733,142 A * 3/1998 Clark ..... 439/567
5,807,135 A * 9/1998 Clark ..... 437/567
5,865,645 A * 2/1999 Embo et al. ..... 439/567
5,921,811 A * 7/1999 Hsu ..... 439/607
6,036,537 A * 3/2000 Wu et al. ..... 439/567
6,077,115 A * 6/2000 Yang et al. ..... 439/607
6,106,331 A * 8/2000 Kurotori et al. ..... 439/567
6,210,220 B1 * 4/2001 Zhu et al. ..... 439/567

* cited by examiner

*Primary Examiner*—Gary Paumen
(74) *Attorney, Agent, or Firm*—Wei Te Chung

(57) ABSTRACT

An electrical connector (1) comprises an insulating housing (10) receiving a plurality of terminals (20) therein. A pair of grounding devices (50) and locking devices (40) are assembled to the housing and engage with each other. The housing defines first and second receiving slots (16*a*, 16*b*). The housing also defines an arced recess between the first and second slots. Each locking device comprises first and second locking arms (44, 46). A circular nut (48) is integrally formed with the first arm, and is fittingly received in an arced lower portion of the arced recess. The nut threadedly engages with a locking portion (56) of a corresponding grounding device.

1 Claim, 5 Drawing Sheets

ELECTRICAL CONNECTOR HAVING LOCKING DEVICE

BACKGROUND OF THE INVENTION

1. Field of the Invention

The present invention relates to an electrical connector, and particularly to an electrical connector having a locking device for securely locking the connector to a printed circuit board.

2. Description of Related Art

U.S. Pat. No. 4,874,336 discloses an electrical connector 2 comprises a pair of locking devices 50 for securing the connector to a printed circuit board. The pair of locking devices are assembled to two opposite lateral ends of an insulating housing 20 with two lateral edges of the upper and the bottom plates 54, 52 engaging with slots 36 and 38 of the housing. However, this securing relationship is not so reliable that the locking devices 50 may shift from their intended position whereby fastening members 120 cannot have a proper threaded engagement with threaded members 58 when the fastening members 120 are extended through holes 86 of a shield member 70 to threadedly engage with the threaded members 58.

Hence, an improved electrical connector having a locking device is required to overcome the disadvantages of the prior art.

BRIEF SUMMARY OF THE INVENTION

An object of the present invention is to provide an electrical connector having a locking device which integrally forms an internal threaded portion therein and can be securely positioned to a housing of the connector so that a member having an external thread can readily engage with the internal threaded portion of the locking device.

To fulfill the above-mentioned object, an electrical connector of the present invention comprises an insulating housing having first, second slots and a recess between the first and second slots. A plurality of terminals are received within the housing. At least a locking device is assembled to the housing, each locking device comprising first and second locking arms connected to each other, said first and second locking arms being respectively received within the first and the second receiving slots, the locking device further having a nut fixed with the first locking arm and being fitted within the recess. A shield encloses the housing defining a through hole aligned with the holes of the housing. A grounding device is assembled to and engaged with the locking device.

Other objects, advantages and novel features of the invention will become more apparent from the following detailed description of the preferred embodiment when taken in conjunction with the accompanying drawings.

DETAILED DESCRIPTION OF THE INVENTION

Figure 1:
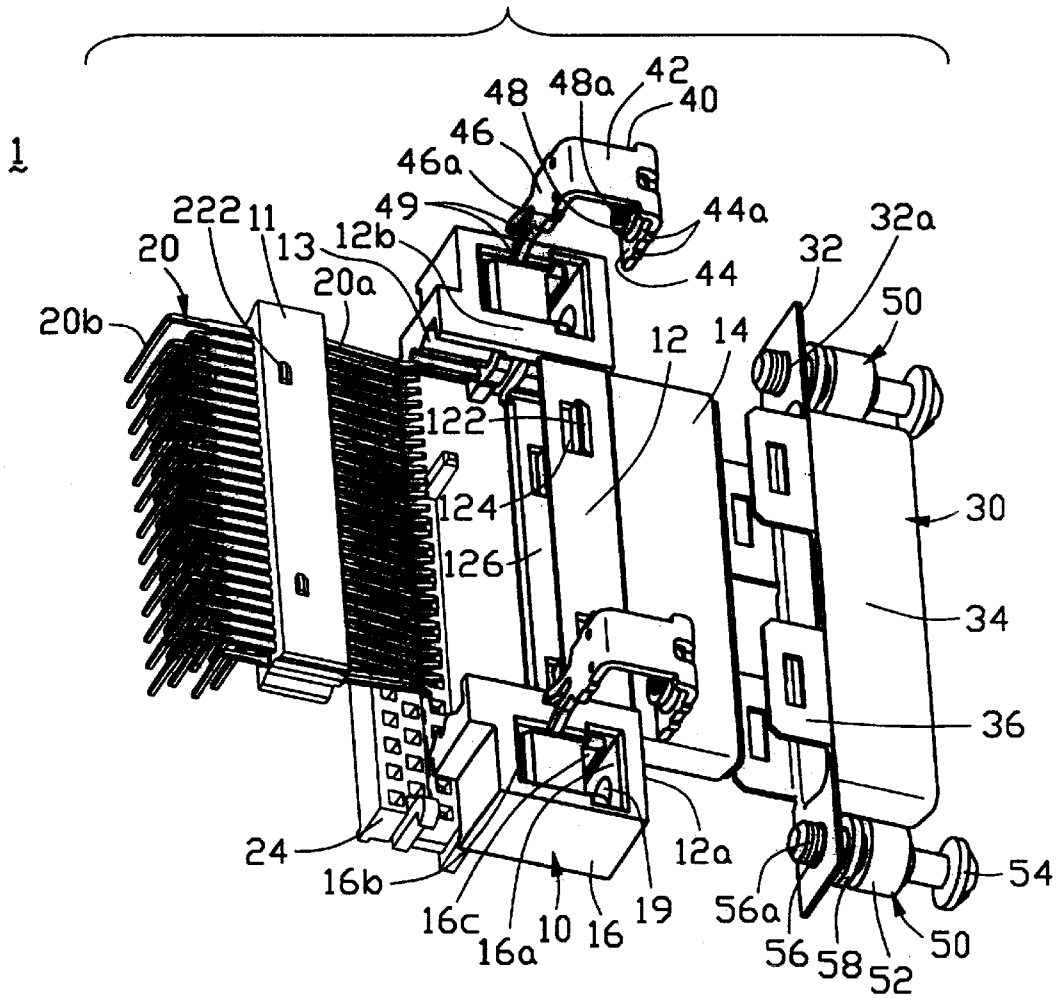
FIG. 1 is an exploded view of an electrical connector in accordance with the present invention.

Referring to FIG. 1, an electrical connector 1 of the present invention comprises an insulating housing 10, a plurality of terminals 20 fixed to an insulating insert 11, a shield 30 for enclosing a shroud 14 of the housing 10, a pair of metallic locking devices 40 to be secured on two lateral ends of the housing 10 and a pair of metallic grounding devices 50 for engaging with the locking devices 40.

Figure 2:
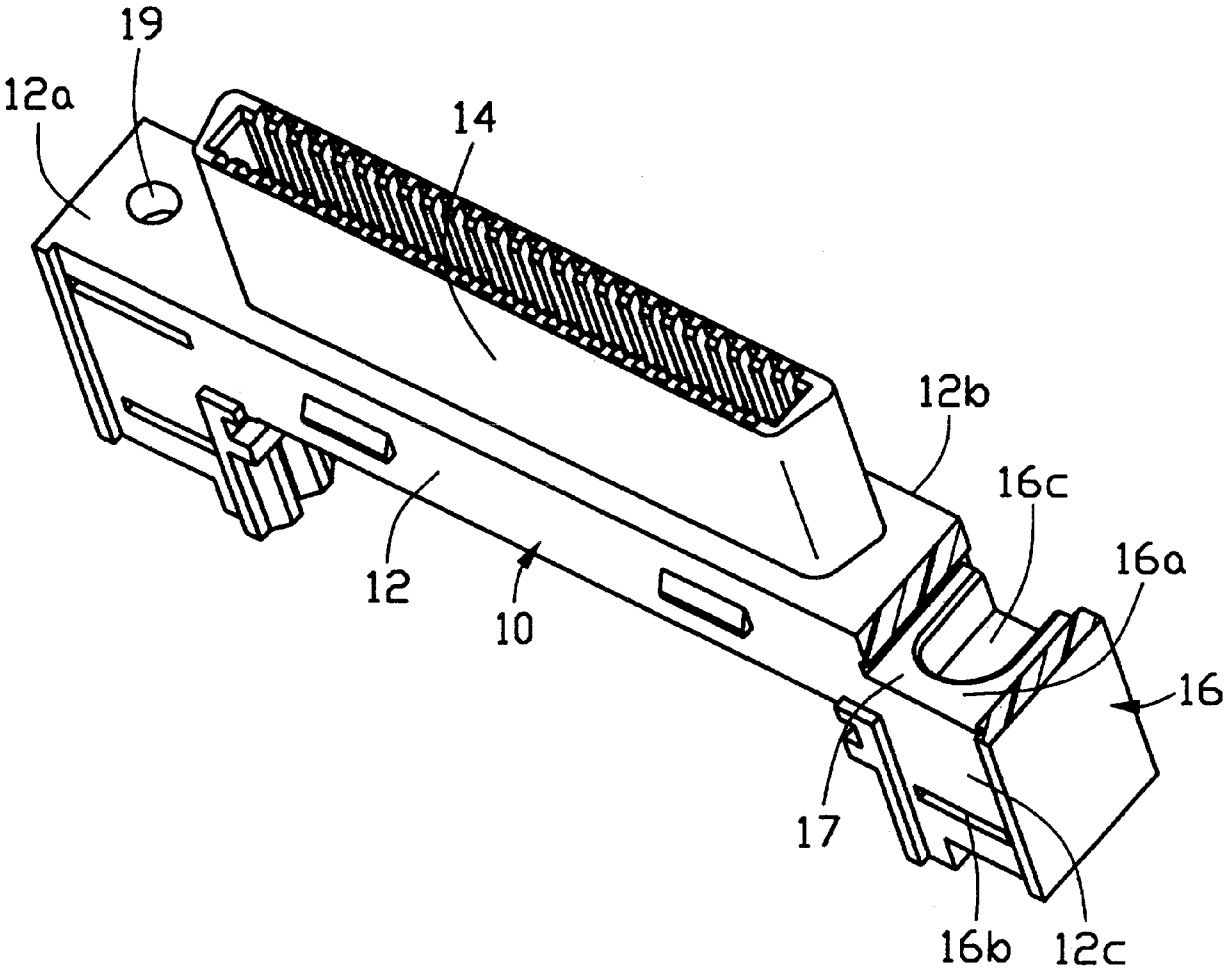
FIG. 2 is a perspective view of an insulating housing of the connector of FIG. 1 from a different aspect in which a portion of the housing is cut away.
Figure 3:
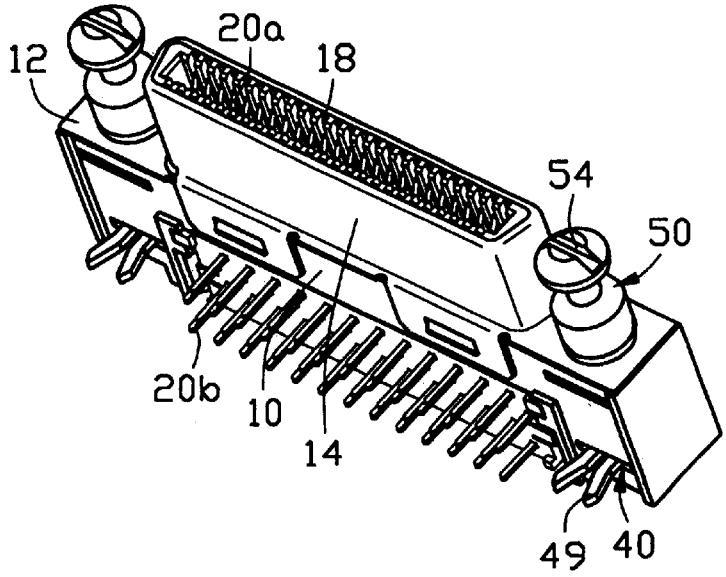
FIG. 3 is an assembled view of the present invention.
Figure 4:
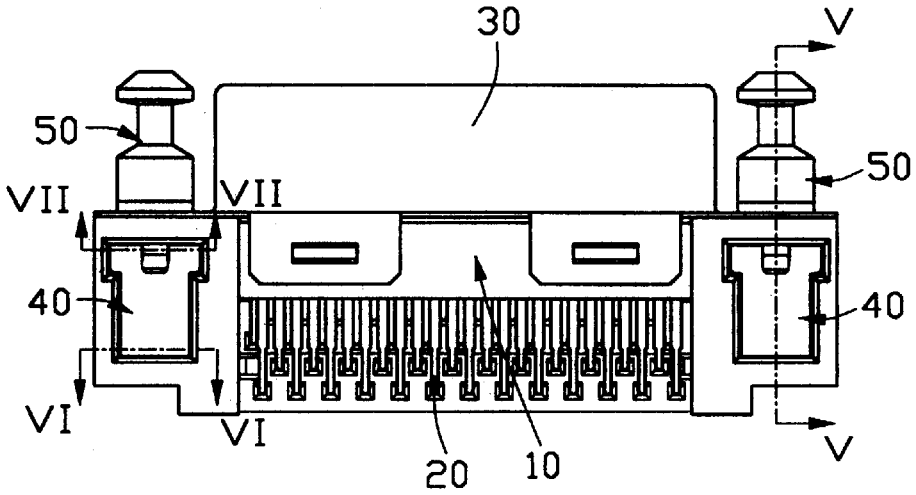
FIG. 4 is a top view of FIG. 3.

Also referring to FIGS. 2–4, the housing 10 comprises a base 12 having a mating face 12*a*, a shroud 14 extending forwardly from the mating face 12*a* and a plurality of terminal receiving channels 18 defined in the shroud 14. A block 16 is formed at each of two lateral ends of the housing 10. The housing 10 also defines first and second receiving slots 16*a*, 16*b* both parallel to the mating face 12*a* and extending through an upper face 12*b* and a bottom face 12*c* of the housing 10. An arced recess 16*c* depressed from the top face 12*b* is defined in each block 16 between the first and second receiving slots 16*a*, 16*b*. The housing 10 further defines apair of holes 19 in the mating face 12*a* communicating with the first receiving slot 16*a* and the arced recesses 16*c*.

The housing 10 further forms a spacer 24 at a rear, lower portion thereof. A pair of rails are formed by the housing 10 between the shroud 14 and the spacer 24 along the front-to-rear direction and between the blocks 16 along the lateral direction. A pair of hooks 122 is formed to project from each of top and bottom faces of the base 12 of the housing 10. A hole 124 is defined in the base 12 neighboring a corresponding hook 122. An opening 126 is defined in the base 12 communicating with the terminal receiving channels 18. The insert 11 forms a pair of protrusions 222 on each of its top and bottom faces (only a pair being shown). A groove 22 is defined in each of lateral sides of the insert 11. The terminals 20 each have a mating portion 20*a* in front of the insert 11 and a right-angled tail portion 20*b* in rear of the insert 11. The terminals 20 are assembled with the housing 10 by inserting the insert 11 into the opening 126 to reach aposition in which the rails 13 fit in the grooves 22, the protrusions 222 fit into the holes 124, the mating portions 20*a* of the terminals 20 are received in the receiving channels 18, and the tail portions 20*b* extend through the spacer 24.

Each locking device 40 comprises a flat connecting portion 42, a first locking arm 44 extending from an end of the connecting portion 42 and a second locking arm 46 extending from the other end of the connecting portion 42 parallel to the first locking arm 44 so that the locking device 40 has a U-shaped configuration. Each locking arm 44 and 46 forms a plurality of protrusions 44*a*, 46*a* on two opposite edges thereof. The second locking arm 46 also forms two separate resilient legs 49 at a free end thereof. A circular nut 48 is integrally formed with the first locking arm 44 and protrudes toward the second locking arm 46. The nut 48 has an inner threaded portion 48*a*.

The shield 30 comprises an abutting portion 32 for abutting against the mating face 12*a* of the housing 10, and a shielding portion 34 for enclosing the shroud 14. The shield 30 further defines two through holes 32*a* correspondent to the holes 19 of the housing 10.

Each grounding device 50 comprises a body portion 52, a driving portion 54 and a locking portion 56 having an outer thread 56*a*. A helical spring 58 is assembled to the grounding device 50 between the body portion 52 and the locking portion 56. The grounding devices 50 are used to connect with a shield of a mating connector and the locking devices 40.

Figure 5:
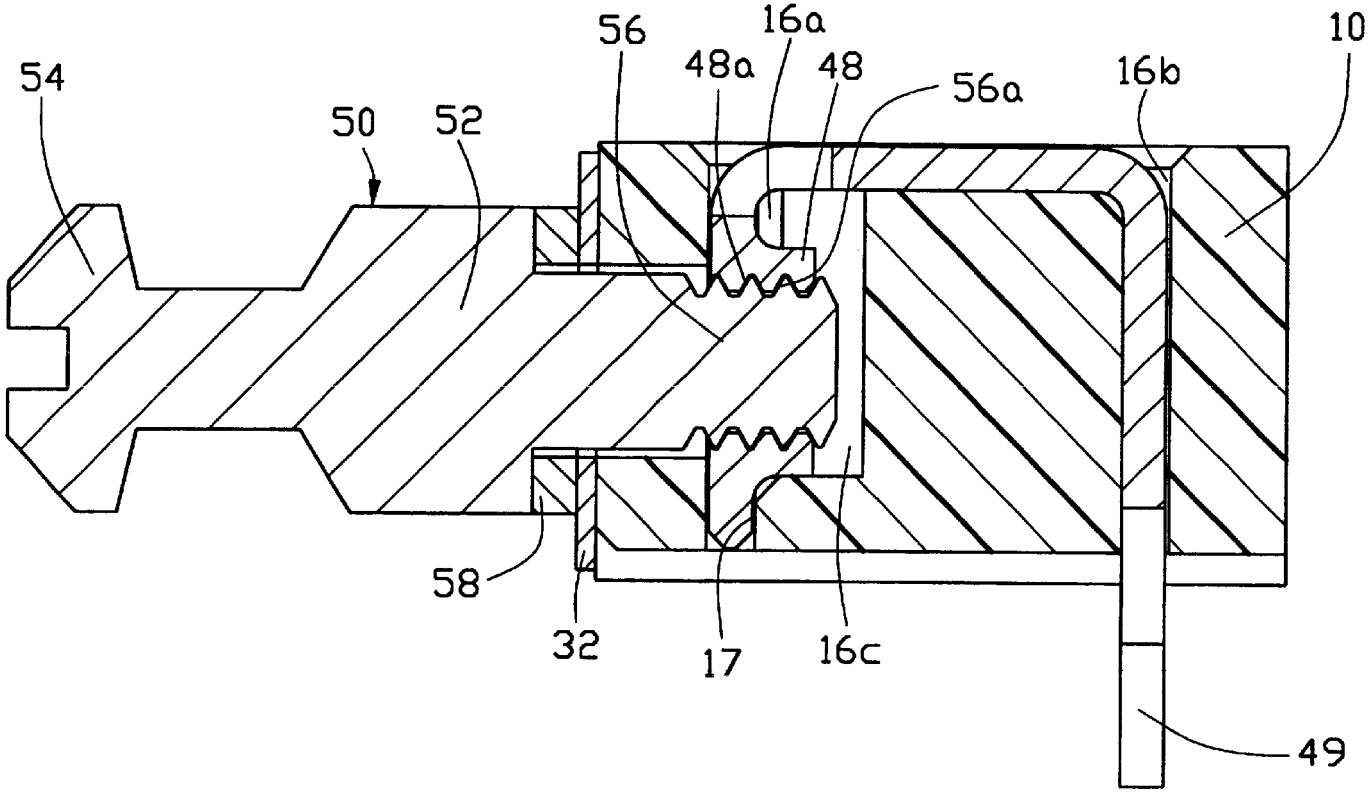
FIG. 5 is a cross-sectional view taken from line V—V of FIG. 4.
Figure 6:
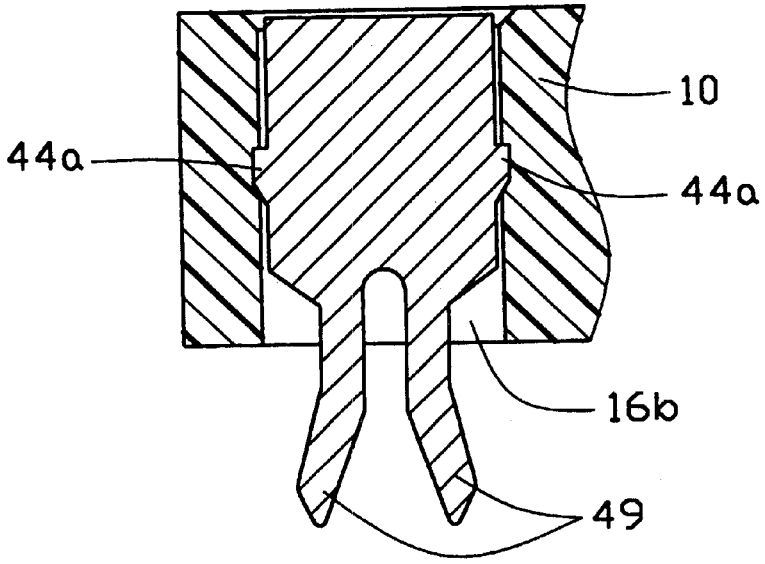
FIG. 6 is a cross-sectional view taken from line VI—VI of FIG. 4.
Figure 7:
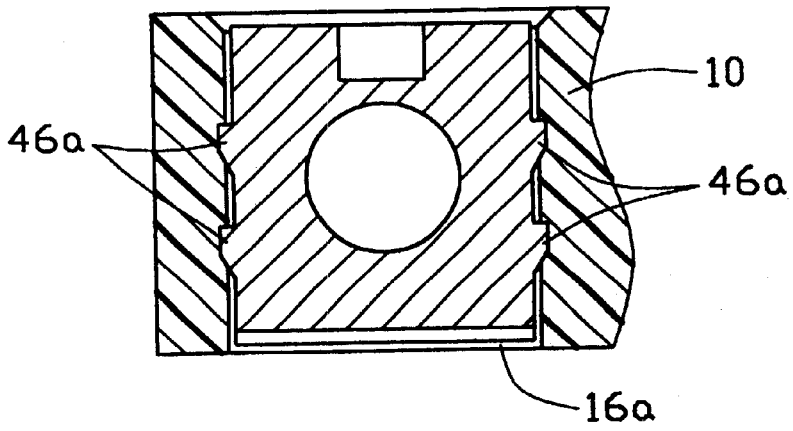
FIG. 7 is a cross-sectional view taken from line VII—VII of FIG. 4.

Referring to FIGS. 1, 2 and 5, in assembly, the locking devices 40 are assembled to two lateral ends of the housing 10 from the upper face 12*b* of the housing 10, wherein the first and second locking arms 44, 46 respectively fit within the first and second receiving slots 16*a*, 16*b*, thereby preventing the locking devices 40 from moving along the front-to-rear direction. The nuts 48 of the locking devices 40 fit within the third receiving slots 16*c* with a lower semi-circular portion of each of the nuts 48 being fitted in a lower arced portion of a corresponding arced recess 16*c*, whereby the inner threaded portion 48*a* is accurately aligned with a corresponding through hole 19. The protrusions 44*a*, 46*a* of the first and the second locking arms 44, 46 have an interferential engagement with two blokes 16 of the housing 10 thereby preventing the locking devices 40 from having an upward movement. The shield 30 is then assembled to the housing 10 from the mating face 12*a* thereof, wherein the through holes 32*a* are alignedwith the through holes 19 of the housing 10. The shield 30 forms rearwardly extending ears 36 engaging with the hooks 122. The shielding portion 34 of the shield 30 encloses the shroud 14. Finally, the locking portions 56 of the grounding devices 50 are inserted to engage with the thread 48*a* of the nuts 48 through the holes 32*a* of the shield 30 and the through holes 19 of the housing 10. The helical springs 58 are compressed between the abutting portion 32 of the shield 30 and the body portions 52 of the grounding devices 50.

An advantage of the present invention is that the nuts 48 each have a circular configuration fitted in the lower arced portion of the arced recess 16*c* thereby accurately aligning the inner threaded portion 48*a* with the through holes 19 so that the locking portions can easily and reliably extend through the through hole 19 to threadedly engage with the inner threaded portions 48*a*.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulating housing;

a plurality of terminals received within the housing;

at least a U shaped locking device having first and second locking arms connected by a connecting portion, said first arm having integrally formed hereon a circular nut protruding toward the second arm, said first and second arms extending into first and second slots defined by the housing and having an interferential engagement with the housing, said circular nut being fitted in an arced recess defined by the housing and located between the first and second slots, said nut defining a threaded hole in alignment with a hole defined by the housing;

a metal shield enclosing the housing; and a grounding device having a locking portion threadedly engaging with the threaded hole of the nut;

wherein the second arm forms resilient legs adapted for engaging with a printed circuit board thereby securing the connector to the printed circuit board;

wherein the terminals are fixed to an insulating insert;

wherein the housing forms a spacer at a rear, lower portion thereof, the terminals each having a mating portion located in front of the insert and received in a passageway defined in the housing, and a right angled tail portion extending through the spacer;

wherein the insert forms grooves in lateral sides thereof, said groove fittingly receiving rails formed by the housing;

wherein protrusions are formed on top and bottom faces of the insert, the protrusions fitting into holes defined in the housing thereby fixing the insert together with the terminals to the housing;

wherein the grounding device further has a body portion, a helical spring located between the locking portion and the body portion, the helical spring being compressed between the shield and the body portion of the grounding device.

* * * * *